US005505435A

United States Patent [19]

Laszlo

[11] Patent Number: 5,505,435

[45] Date of Patent: Apr. 9, 1996

[54] SLAG CONTROL METHOD AND APPARATUS

[75] Inventor: William S. Laszlo, Lockport, Ill.

[73] Assignee: Industrial Maintenance and Contract Services, Munster, Ind.

[21] Appl. No.: 309,128

[22] Filed: Sep. 20, 1994

Related U.S. Application Data

[60] Division of Ser. No. 84,348, Jun. 28, 1993, Pat. No. 5,375,818, which is a continuation-in-part of Ser. No. 832,719, Feb. 7, 1992, Pat. No. 5,240,231, and Ser. No. 912,844, Aug. 7, 1992, abandoned, said Ser. No. 832,719, is a continuation-in-part of Ser. No. 722,524, Jun. 27, 1991, Pat. No. 5,173,244, which is a continuation-in-part of Ser. No. 560,598, Jul. 31, 1990, Pat. No. 5,173,243, said Ser. No. 912,844, is a continuation of Ser. No. 560,598.

[51] Int. Cl.[6] ..... B22D 41/40

[52] U.S. Cl. ..... 266/45; 266/230; 266/231; 266/240

[58] Field of Search ..... 266/45, 230, 231, 266/238, 240

[56] References Cited

U.S. PATENT DOCUMENTS

| | | | |
|---|---|---|---|
| 1,690,748 | 11/1928 | Moyer | 266/231 |
| 5,173,243 | 12/1992 | Laszlo | 266/45 |
| 5,173,244 | 12/1992 | Laszlo | 266/231 |
| 5,240,231 | 8/1993 | Laszlo | 266/45 |
| 5,375,818 | 12/1994 | Laszlo | 266/230 |

*Primary Examiner*—Scott Kastler
*Attorney, Agent, or Firm*—Dressler, Goldsmith Shore & Milnamow, Ltd.

[57] ABSTRACT

A method and apparatus are provided for controlling slag in a trough of a tilting furnace or in a free-standing tilting vessel. On a tilting furnace, the apparatus is mounted on a trough extending from the furnace tap hole and has a reservoir for receiving flow of molten metal and slag from the trough. The reservoir has a slag opening. One of its walls functions as a dam with a bottom opening. A passage extends from the bottom opening along a weir which terminates at an elevation above the bottom opening but below the slag opening. The molten metal flows over the weir and out of the device. The slag is retained in the reservoir and is discharged from the reservoir through the slag opening. In the free-standing tilting vessel, there is a reservoir, slag opening, dam portion, bottom opening, passage and weir, of a substantially similar design as that of the apparatus attached to a trough of a tilting furnace.

17 Claims, 8 Drawing Sheets

SLAG CONTROL METHOD AND APPARATUS

CROSS-REFERENCE TO RELATED APPLICATIONS

This application is a division, of application Ser. No. 08/084,348, filed Jun. 28, 1993, now U.S. Pat. No. 5,375,818 which application is a continuation-in-part of U.S. patent application Ser. No. 07/832,719, filed Feb. 7, 1992, U.S. Pat. No. 5,240,231 and U.S. patent application Ser. No. 07/912,844, filed Aug. 7, 1992 now abandoned. Ser. No. 07/832,719 is a continuation-in-part of Ser. No. 07/722,524, filed Jun. 27, 1991 and issued as U.S. Pat. No. 5,173,244, which is a continuation-in-part of Ser. No. 07/560,598, filed Jul. 31, 1990 and issued as U.S. Pat. No. 5,173,243. Ser. No. 07/912,844 is a continuation of Ser. No. 07/560,598. The specifications of Ser. No. 07/832,719, Ser. No. 07/912,844 and Ser. No. 07/722,524 are incorporated herein by reference.

TECHNICAL FIELD

The present invention relates generally to a method and apparatus for removing slag that separates from molten metal. The method and apparatus are particularly suitable for removing slag that separates from molten metal which is discharged from a tilting electric arc furnace.

BACKGROUND OF THE INVENTION

When scrap metal is heated to a liquid, molten state, certain impurities may be separated from the molten metal by the introduction of conventional fluxes which react with the impurities to form what is conventionally known as furnace slag. This slag rises to the surface and floats on top of the molten metal.

Slag is of little or no value in making use of the molten metal from the furnace. To the contrary, furnace slag can interfere with alloy additives in various metal specifications.

For example, in making alloyed steel, soluble oxygen is an unwanted contaminant. Slag which rises to the top of molten steel contains a large amount of soluble oxygen. If slag is present when alloys are added to the molten steel, then the soluble oxygen in the slag will react with the alloys and inhibit the alloys from reacting with the molten steel. Thus, the slag inhibits the alloying process. Also, the presence of slag in the molten steel facilitates the formation of particulate inclusions which, if large enough, may be detrimental to the physical properties of the steel.

Since furnace slag is a contaminant which may have a deleterious effect on making alloy steels, it is desirable to separate the slag from the molten metal before alloys are added to the molten metal. Therefore, slag separation is usually effected before alloys are added to the molten steel. Any slag which is separated is usually discarded. The process of separating slag from molten steel is often known as slag control.

Slag control has been a particularly difficult problem when scrap steel is melted in tilting furnaces and then discharged into a container or "ladle" before adding alloys. As discussed below, there have been numerous attempts at separating slag from molten steel that is discharged from a tilting furnace.

The typical electric furnace is mounted on a tilting platform. A tap hole is located on the side of the furnace. A discharge trough is mounted on the side of the furnace, just below the tap hole.

When the furnace is heated, scrap steel in the furnace melts into a molten liquid state. Slag separates from the molten steel and floats in a separate layer on top of the molten steel.

The tap hole is opened when the furnace is in the upright position. When the tap hole is opened, it is usually located above the level of the floating slag and molten metal. However, in some cases, it may be located below the level of the floating slag.

When the furnace is tilted, the operator of the furnace will attempt to tilt the furnace sufficiently so that the tap hole is below the top of the molten metal and permits the molten steel to flow through the tap hole. The slag remains inside the furnace and floats at a level above the level of the tap hole. As the molten steel drains from the furnace, the operator increases the angle of tilt in order to keep the slag at a level above the level of the tap hole. Thus, the operator attempts to cause all of the molten steel to flow through the tap hole before the slag begins to flow through the tap hole. This process of pouring or tapping is conventionally known as the "tap".

As slag floats on top of molten steel, there is a very fluid layer of floating slag, known as interface slag, which floats in a layer between the molten steel and the rest of the floating slag. The interface slag has much less viscosity, and a higher concentration of soluble oxygen, than the rest of the floating slag. Interface slag is particularly deleterious to the alloying process.

While molten steel is flowing through the tap hole, a vortex forms. The vortex draws interface slag through the tap hole while the molten steel is flowing through the tap hole.

The operator cannot see the vortexing of the interface slag because the furnace is usually enclosed on all sides and the top. Therefore, there is very little that the operator can do to prevent the interface slag from contaminating the molten steel during the tap.

During the tap, the level of the molten metal and floating slag in the furnace falls until the floating slag is at the level of the tap hole. At this point, the floating slag will begin to flow through the tap hole and contaminate the molten steel which has already been poured from the furnace. In order to prevent the flow of slag through the tap hole, the operator attempts to stop the tapping process quickly by closing the tap hole and/or returning the furnace to the upright position.

However, because a tilting furnace is usually fully enclosed, the operator usually cannot see inside the furnace to determine exactly when the slag is about to flow through the tap hole. Therefore, the operator usually waits until he sees slag coming out of the tap hole and into the trough before attempting to stop the flow of slag and returning the furnace to the upright position. This is the traditional method of slag control in a tilting furnace.

There have been numerous attempts to supplement or improve this basic method of slag control on tilting furnaces, including the use of tap hole gates, Vost-Alpine slag stoppers, the E-M-L-I system, and various stopper devices or plugs.

Tap hole gates are sliding or rotary gates which are mounted on the outside of the furnace adjacent the tap hole. The operator closes the gate when slag begins to discharge from the tap hole.

The Vost-Alpine slag stopper is a large, articulating nitrogen gas cannon which is used to close the tap hole. Operating under very high pressure, the cannon discharges nitrogen gas into the tap hole of the furnace on demand, and this stops the flow of molten steel and slag through the tap hole. Thus, the Vost-Alpine slag stopper is functionally analogous to a tap hole gate.

The E-M-L-I system consists of an electronic sensor which is mounted to the furnace inside the tap hole refractory. The E-M-L-I senses when a predetermined percentage of slag is entrained in the molten metal which is flowing through the tap hole. When the predetermined percentage is sensed by the E-M-L-I unit, the sensor communicates this to the operator of the furnace, who will then return the furnace to the upright position. Thus, the E-M-L-I system is used to control slag by directing the operator of the furnace to stop flow through the tap hole as soon as a predetermined amount of slag begins to flow through the tap hole.

A variety of stopper devices or plugs are used to control slag. They have a variety of shapes including the shapes of a tetrahedron or globe (also known as "cannonball"). A plug is placed inside the furnace and floats in the interface between the molten metal and floating slag. When the interface and plug drop to the level of the tap hole during the course of a tap, the plug is drawn by suction to the tap hole and blocks flow through the tap hole.

The eccentric bottom tapping gate is another attempt at slag control in an electric arc furnace. It requires that the tap hole be made in the bottom, rather than the side, of the furnace. When the operator observes slag pouring from the furnace, he closes a sliding gate to block the tap hole and prevent further flow through the tap hole. This method of slag control is quite expensive because it requires modification of an existing furnace to create a virtually new furnace and new ladle transfer cars or turrets to receive the molten steel as it is discharged from the furnace. The ladles must be moved from the side of the furnace and placed underneath the bottom of the furnace.

None of these prior methods of slag control for a tilting furnace have performed particularly well. None of them solves the problem of contamination of the molten steel with interface slag which vortexes through the tap hole while the molten steel is flowing through the tap hole. None of them solves the problem of contamination of the molten steel with slag which flows through the tap hole at the end of a tap before the operator can react to stop the flow through the tap hole. Most of these methods also stop the flow of some of the molten steel, thus reducing the yield.

The above-described prior art methods and apparatus do not control slag after it escapes through the tap hole of a tilting furnace. Instead, they simply function to attempt to stop flow through the tap hole when it is determined that most of the molten steel has been discharged through the tap hole and floating slag is beginning to flow through the tap hole. None of these prior art methods and apparatuses control or remove the slag from the flow after the flow has been discharged through the tap hole and into the trough.

It would be desirable to control slag in a tap discharge of molten metal after it flows through the tap hole into the trough and before it flows out of the trough and into the ladle.

It would also be beneficial if such an improved system could be effectively and readily employed on a tilting electric arc furnace having an attached discharge trough.

Additionally, such an improved system should provide for positive separation and control of the slag, including interface slag, from the molten metal.

Further, it would be desirable to provide an improved system which would permit the viewing of the level of molten metal and floating slag in the trough in order to coordinate the separation of the slag and metal, as well as the retention and discharge of the slag in a positive manner.

It would be beneficial to provide such a system which can be implemented by apparatus that can be removed and replaced as necessary, without requiring removal or replacement of the entire trough or furnace.

In particular, it would be desirable to provide a slag control system which can operate relatively efficiently and in a manner that will accommodate a relatively high flow rate in the tap discharge so as to minimize the total time required for the tap discharge (i.e., pour time). This would serve to reduce the amount of heat absorbed by the system, such as the refractory brick and steel supporting frame. This would also reduce the thermal cycle peaks and minimize the thermal degradation and wear of the materials.

In addition, a reduced tap discharge time can reduce the amount of gases absorbed by the molten metal in the trough, as well as in the ladle. In particular, it would be desirable to reduce the amount of nitrogen and oxygen absorbed by molten steel during tap discharges.

It would also be beneficial to provide a slag control system that would accommodate relatively high flow rates, and therefore reduce the total tap discharge time, so as to prevent an excessive temperature drop in the molten metal flowing along the trough as well as in the molten metal in the ladle. If high enough flow rates can be accommodated through an improved slag control system, the need to reheat the steel in the ladle may be eliminated or at least minimized.

For example, in one type of conventional electric arc furnace having a tap hole with a diameter of between 8 inches and 12 inches and having a conventional open trough, a tap discharge of 80 tons of molten slag and steel might require about 3 minutes. It would be desirable to provide an improved slag control system which, during operation, would not add significantly to the tap discharge time.

It would also be desirable to provide an improved slag control system which could readily accommodate designs employing sufficient thicknesses of refractory materials reduce heat transfer from the molten steel and to provide sufficiently rugged designs that can better withstand the effects of the hot flowing metal and high temperatures.

Further, it would be advantageous if an improved slag control system would be provided with the capability for eliminating or substantially minimizing irregularities in molten metal flow. Such flow irregularities are undesirable and can contribute to entraining slag into the molten metal through vortex effects or through other effects. The likelihood of entraining slag, or drawing interface slag, into the molten metal increases with time near the end of the tap discharge when the ratio of the steel to the slag in the total flow is relatively low. Of course, the inclusion of slag in the molten steel is undesirable for the reasons discussed in detail above.

Further, it would be desirable to provide an improved slag control system for controlling a discharge of molten metal and slag from a furnace wherein an apparatus for receiving the molten metal and slag is completely detached from the furnace and can be controlled and tilted on its own.

The present invention improvements are directed to minimizing the above-described problems, and the invention provides a number of operating improvements.

SUMMARY OF THE INVENTION

This invention provides an apparatus and method for controlling slag in a tap discharge of molten metal and slag from a tap hole of a tilting furnace which is variably tiltable between an upright, non-tilted position and a fully-tilted position.

One form of the apparatus of the present invention includes a device that can be mounted on a trough that normally extends outwardly from the furnace tap hole and which defines a flow channel for the molten metal and slag. The device defines an inlet for receiving molten metal and slag from the trough flow channel and has an outlet from which the molten metal can be discharged.

The device defines a reservoir communicating with the trough flow channel at the device inlet and defines a slag opening from which the slag can be discharged.

The device further defines a bottom opening to the reservoir below the level of the slag opening and defines a passage communicating between the bottom opening and the outlet. The passage also defines a weir which extends generally upwardly above the level of the bottom of the slag opening and over which the molten metal flows to the outlet. In a preferred form, the passage is laterally offset from the reservoir. The slag opening is located at least as far outwardly as is the weir, and preferably, the slag opening is located further outwardly than the weir.

In an alternative aspect of the invention, a tilting vessel separates molten metal from slag. The vessel has a lateral opening for discharge of slag, a dam portion, an opening in the bottom of the dam portion, a passage extending from the dam opening to a weir, and a discharge opening in the front of the vessel.

In a preferred embodiment of the vessel, a reservoir for receiving molten metal and slag is defined in part by an intermediate wall. The lateral opening is defined in a side wall of the reservoir. The intermediate wall defines in part a dam portion and a dam opening at the bottom of the dam portion. A passage from the dam opening to the weir is laterally offset from the reservoir. The passage extends rearwardly and upwardly from the dam opening to the top of the weir. The tilt control mechanism includes a pair of hydraulic cylinders located at the front and back of the vessel for lifting and tilting the vessel.

According to another aspect of the invention, a method is provided for controlling the slag in the tap discharge of molten metal and floating slag from a tap hole of a tilting furnace which is variably tiltable between an upright, non-tilted position and a fully-tilted position and wherein the furnace has a trough for extending outwardly from the tap hole for directing the flow of the molten metal and slag from the furnace to a discharge outlet. In an alternative aspect of the method, the molten metal and slag are received and then controlled and separated in a tilting vessel.

In this method, the furnace and trough means are sufficiently tilted to discharge the molten metal and slag from the tap hole into the trough means. The molten metal can flow under the influence of gravity out of the discharge outlet during the subsequent process steps. Alternatively, the molten metal and slag are received by the tilting vessel and the vessel is tilted so that the molten metal can flow under the influence of gravity out of the discharge outlet during the subsequent process steps.

In particular, the flow of molten metal is directed sequentially into a reservoir from which the slag can be discharged, into a passage from a bottom opening in the reservoir, then generally upwardly along a weir that is partly defined by the passage, and finally over the top of the weir to the outlet. The slag is retained by the reservoir while permitting the molten metal to flow out of the outlet. The retained slag is discharged through a slag opening defined by the reservoir while maintaining the slag opening at least as far outwardly as the weir and at a level above the level of the bottom opening.

According to a further aspect of the method, the flow of molten metal is directed sequentially into a reservoir, into a laterally offset passage from a bottom opening in the reservoir, then generally upwardly along a weir that is partly defined by the passage, and then over the top of the weir to the outlet. While the molten metal flows out of the outlet, the slag is retained in the reservoir and discharged from the reservoir through the slag opening.

According to another aspect of the invention method, the molten metal is directed into a reservoir from which the slag can be discharged, into a passage from a bottom opening in the reservoir, then generally rearwardly and then upwardly along a weir that is partly defined by the passage, and then over the top of the weir to the outlet. As the molten metal flows out of the outlet, the slag is retained in the reservoir and discharged from the reservoir through the slag opening.

The novel apparatus and method of the present invention can be readily employed with electric furnaces to accommodate a relatively high flow rate. The use of the method and apparatus of the present invention does not increase the tap discharge time to an extent that would cause an undesirable amount of heat absorption in the apparatus and that would cause an undesirably high temperature drop in the molten metal.

The present invention accommodates designs that can better withstand the damaging effects of heat, erosion, and wear.

Further, the system of the present invention can reduce, if not substantially eliminate, flow irregularities and can reduce the likelihood of entraining large amounts of slag in the steel during the tap discharge.

Other features and advantages of the present invention will become readily apparent from the following detailed description, accompanying drawings, and appended claims.

BRIEF DESCRIPTION OF THE DRAWINGS

The invention is described in greater detail in the following description of the preferred embodiment, taken in conjunction with the drawings, in which.

DETAILED DESCRIPTION OF THE PREFERRED EMBODIMENT

Figure 1:
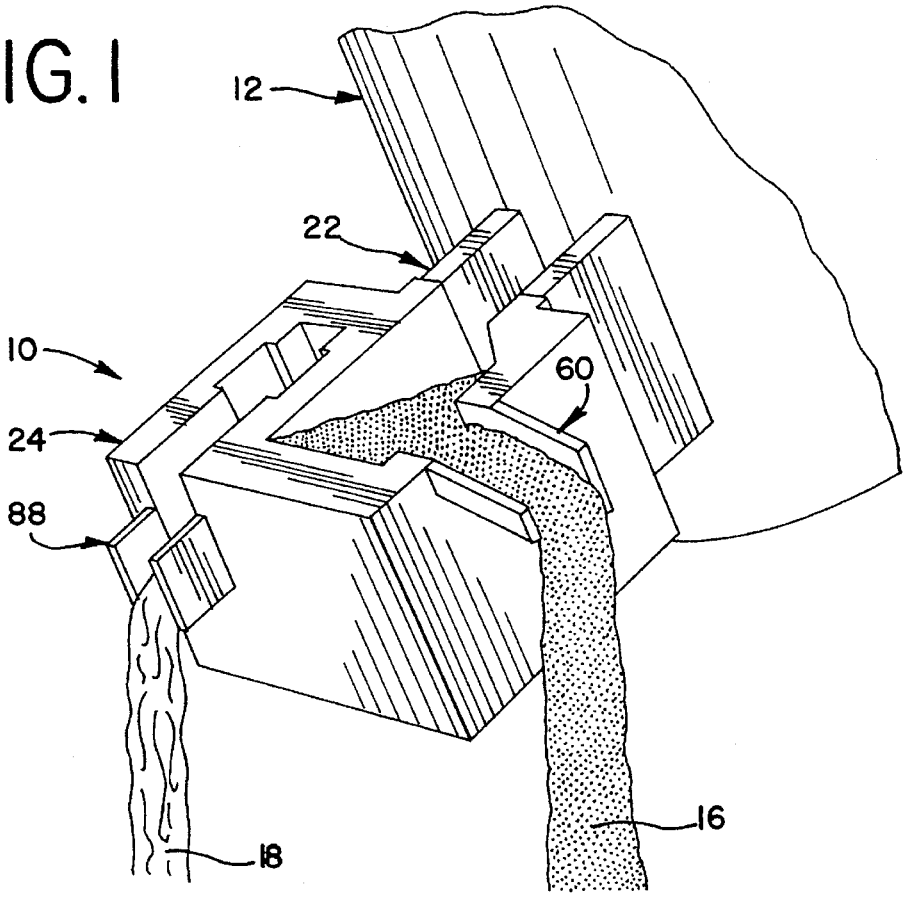
FIG. 1 is a simplified, fragmentary, perspective view of a preferred embodiment of the slag control apparatus of the present invention shown mounted on a tilted electric furnace to discharge separate flows of molten steel and slag.

While the present invention may be embodied in various forms, certain preferred embodiments are shown in the drawings and are described below. However, the description of preferred embodiments is not intended to limit the scope of the invention to the disclosed embodiments. The principles of the invention may be embodied in various other forms which are not described herein.

For ease of description, the apparatus of this invention is described in the normal operating positions, and terms such as upper, lower, horizontal, etc., are used with reference to these positions. It will be understood, however, that the apparatus of this invention may be manufactured, stores, transported, and sold in an orientation other than the positions described.

Some of the figures illustrating the preferred embodiments show structural details and mechanical elements that will be recognized by one skilled in the art. However, the detailed descriptions of such elements are not necessary to an understanding of the invention, and accordingly, are not herein presented.

The present invention provides a novel system for efficiently controlling or separating slag in a tap discharge of molten metal. The system accommodates a relatively high flow rate to minimize the adverse effects of heat absorption by system components and temperature drop of the flowing molten metal and slag.

A preferred form of the apparatus of the present invention is illustrated in a simplified manner in FIG. 1 wherein the apparatus is designated generally by the reference numeral 100 and is shown mounted to the side of a conventional, tilting, electric furnace 12.

Figure 2:
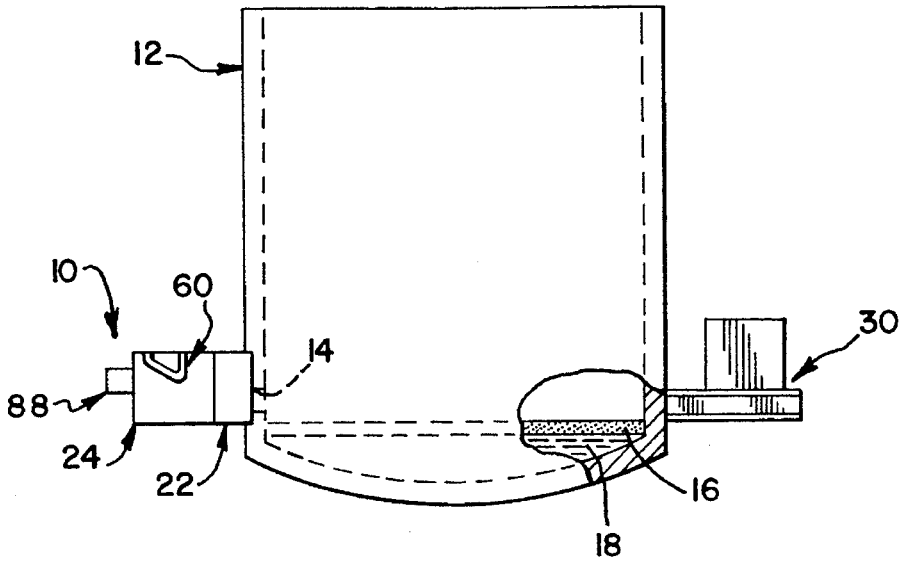
FIG. 2 is a simplified, fragmentary, perspective view of the slag control apparatus and the tilting furnace with the furnace in the normal vertical position and with a portion of the furnace wall cut away to illustrate interior detail.

The furnace 12 is tiltable between a non-discharging, vertical, upright position which is generally illustrated in a greatly simplified manner in FIG. 2 and a final, fully tilted, discharging position which is illustrated in FIG. 1. In the fully tilted position, a typical conventional furnace 12 is tilted between about 36° and about 41° from the vertical.

As illustrated in FIG. 2, the furnace 12 includes a tap hole 14 through which is discharged the molten metal and slag. Typically, the furnace 12 is heated and the metal contained therein is melted. In a fully charged, conventional electric furnace, a floating slag layer 16 forms on top of the melted or molten metal 18. The molten metal 18 lies below the tap hole 14, and the slag layer 16 may extend up to the tap hole 14 or somewhat above the tap hole 14.

Some conventional, tilting, electric, furnaces are provided with an outwardly and upwardly extending trough (not illustrated), and in many cases, the trough is angled upwardly about 15° from the horizontal when the furnace is in the vertical position. The trough is mounted to the furnace at the tap hole and defines a flow channel for directing the molten metal and slag from the furnace tap hole when the furnace is tilted.

Figure 3:
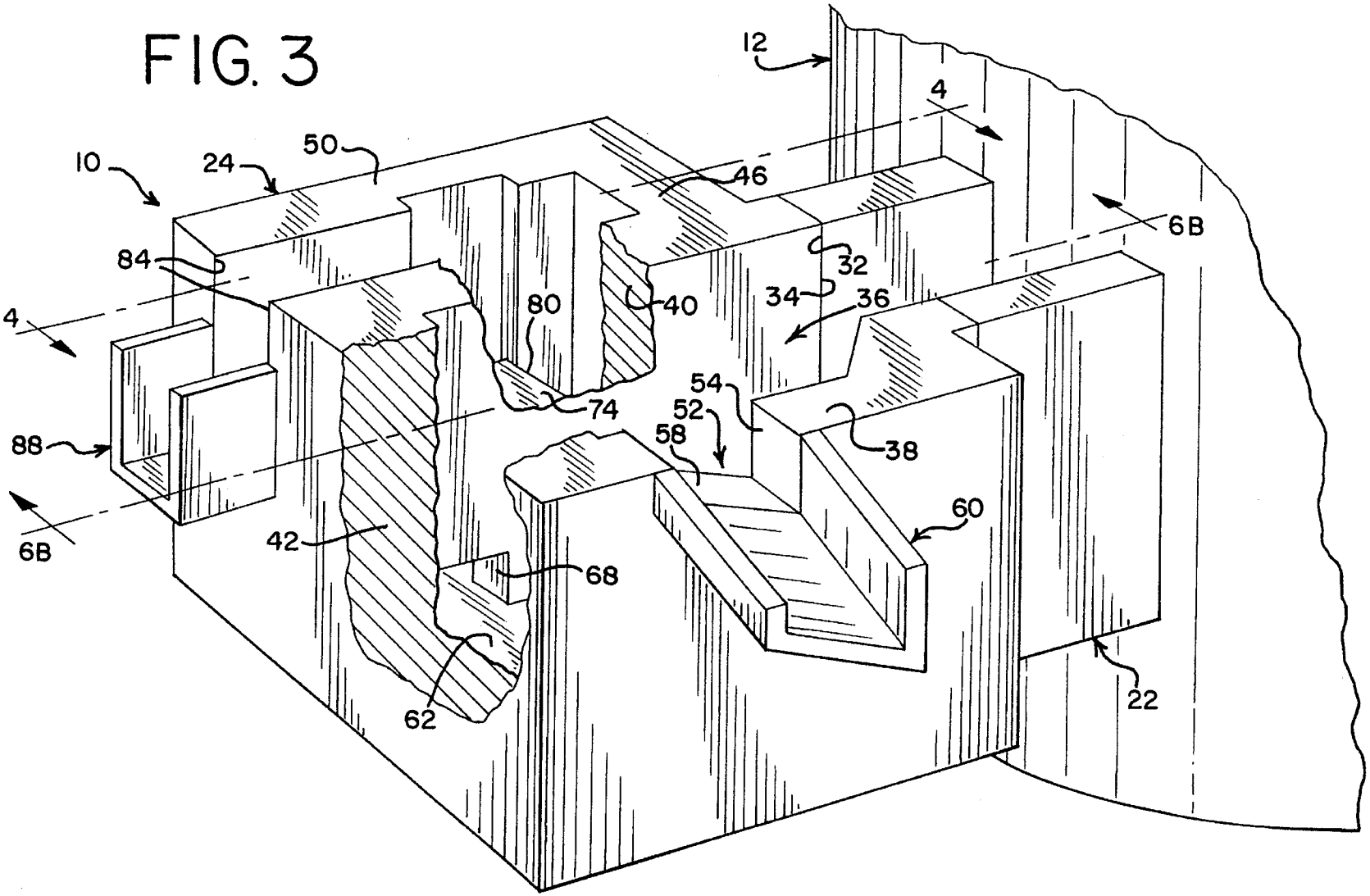
FIG. 3 is a greatly enlarged view similar to FIG. 1, but with the furnace in the normal vertical position prior to a tap discharge.

In the preferred form of the present invention, a vessel in the form of a trough 22 is provided on the furnace 12 at the tap hole 14 so as to extend generally horizontally when the furnace is in the vertical position (FIG. 2). The trough 22 has a slag separating device 24 at its distal end and defines a generally U-shaped, upwardly open, flow channel for directing the molten metal 18 and slag 16 to the device 24 as can be seen in FIG. 3.

The trough 22 and device 24 are preferably fabricated with suitable steel plated shell members and structural support members (not illustrated), and the shell members are lined with refractory material. The refractory material may be a special or conventional case refractory material or refractory brick. The composition of the refractory material can vary depending upon the temperature requirements.

For a typical tilting furnace, the length of the trough 22 would be between about 3 feet and about 5 feet, and the device 24 would project outwardly from the distal end of the trough 22 by an additional amount in the range of between about 5 feet and about 8 feet. The height of the device 24, in the vertical direction parallel to the height of the furnace 12, may lie in the range of about 5 feet to about 9 feet, and the height of the trough 22 could be the same or less. The width of the device 24, perpendicular to the length of the trough 22, could range between about 5 feet and about 9 feet. Of course, depending upon the particular size of the furnace 12, and perhaps on other conditions, the size of the components could be larger or smaller than those described above.

In the preferred form of the invention, the steel plates are provided to form an exterior shell for the trough 22 and device 24. The shell portions can be lined with refractory paper, such as that sold under the trademark FIBERFRAX. The refractory material, such as refractory brick, is placed on this within the steel shell portions.

In view of the large size and associated great weight of the trough 22 and device 24, it may in some situations be necessary, or desirable, to provide a counterweight structure 30 on the furnace 12 at a location 180° from the tap hole 14 as illustrated in FIG. 2. The structural support for, and design of, the counterweight, as well as the structural support for, and design of, the structural members for supporting the trough 22 and device 24, depend upon the design of the particular furnace and clearances around the furnace at the furnace site. Such structural support systems and counterweight systems can be designed according to conventional structural engineering principles, and such designs are no part of the present invention.

Figure 4:
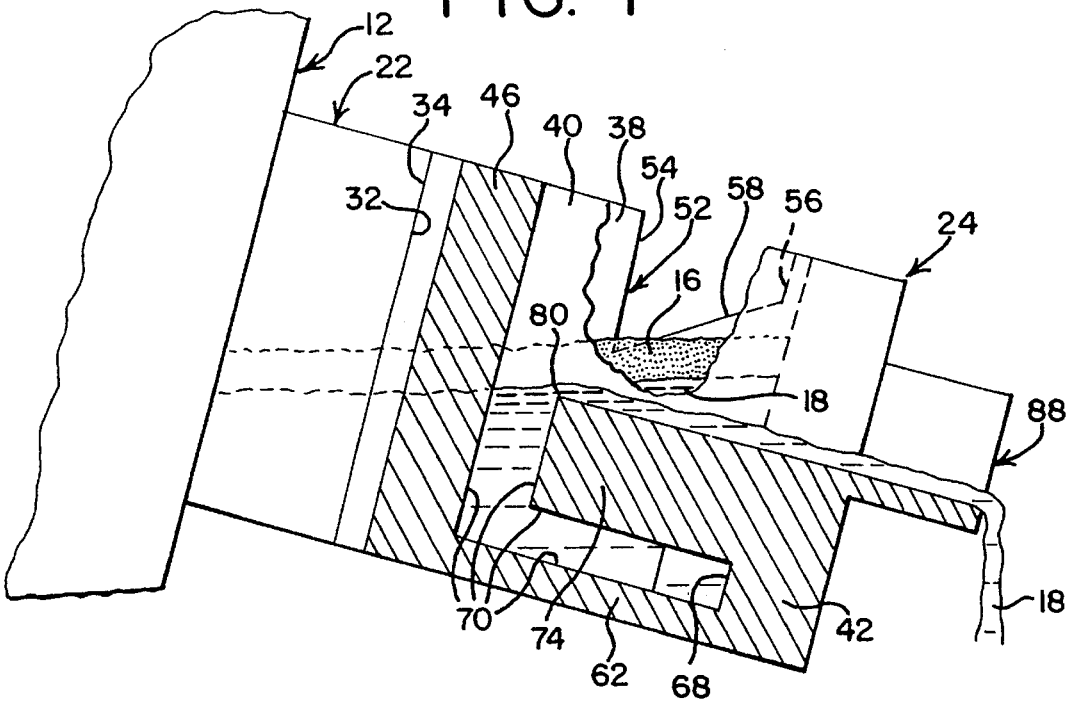
FIG. 4 is a fragmentary, cross-sectional view taken generally along the plane 4—4 in FIG. 3, with certain portions cut away to illustrate interior detail, of a portion of the slag control apparatus with the furnace having been tilted about 15° from the normal upright position shown in FIG. 3 and held in that position for a few seconds after the molten metal and slag have begun discharging from the furnace.
Figure 5:
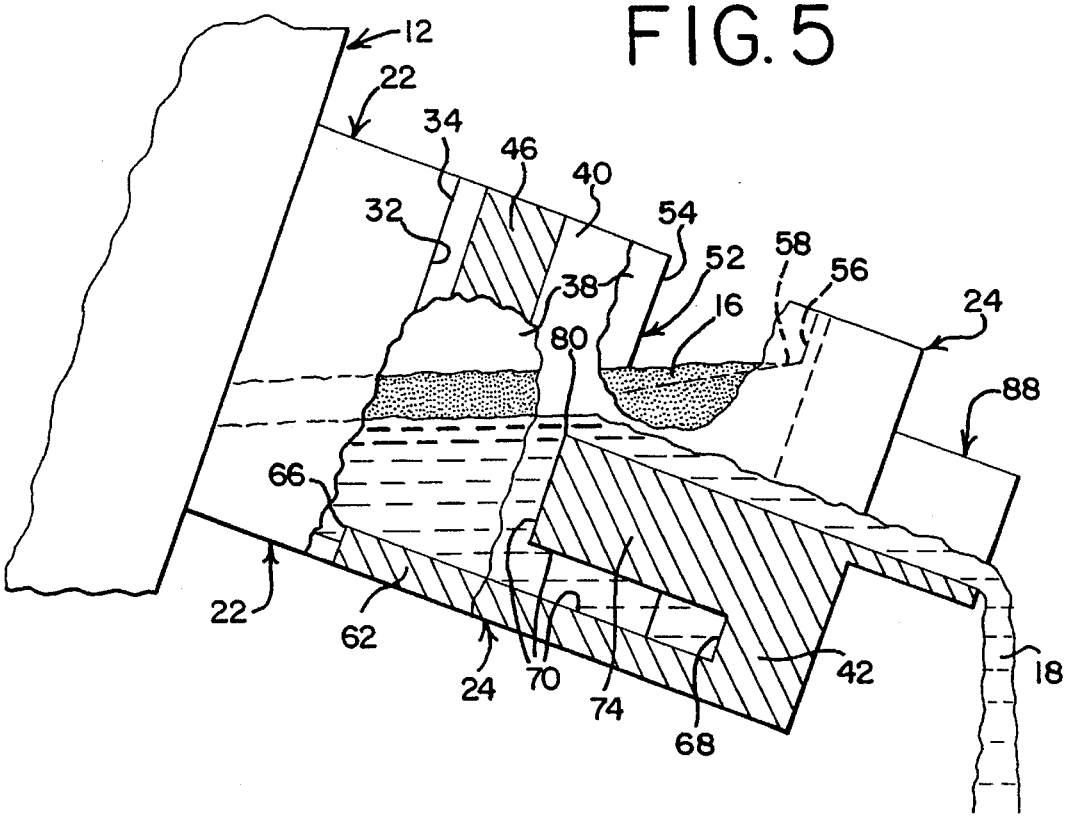
FIG. 5 is a view similar to FIG. 4 with certain portions cut away to illustrate interior detail, but showing the apparatus Just after the furnace has been further tilted to about 20° from the upright position.

With reference to FIGS. 3 and 4, the trough 22 can be characterized as having a distal end 32, and the device 24 can be characterized as having an inlet end 34 which is mounted to the trough distal end 32. The device 24 defines a reservoir 36 in communication with the flow channel of the trough 22 at the device inlet end 34.

The reservoir 36 is defined on one side by a side wall 38 and on the other side by an intermediate wall 40. On the side of the device 24, spaced from the intermediate wall 38, is another side wall 50. The device 24 includes a front wall 42 which defines the front of the reservoir 36 and extends between the side walls 38 and 50. Further, the device 24 has a rear wall 46 extending across the back end of the device 24 except where the reservoir 36 is open to the interior of the trough 22.

In the upper portion of the reservoir 36, the side wall 38 defines a slag opening or notch 52 from which the slag 16 can be discharged in a manner described in detail hereinafter. The slag opening 52 includes a vertical, rear or inner surface or wall 54 and a vertical, front or outer surface or wall 56 (FIG. 4). The vertical walls 54 and 56 are joined by a bottom wall 58 which is angled, in a preferred embodiment, at about 30° relative to the horizontal (i.e., relative to a horizontal line that is perpendicular to the vertical axis of the furnace when the furnace is in the vertical, upright position).

In the preferred embodiment, the slag opening 52 is a notch which is cut out from the top of the side wall 38. However, the other suitable openings in the side wall 38 may be used.

A slag chute 60 is mounted to the device side wall 38 and extends laterally outwardly from the slag opening 52 for discharging the slag 16 to a preselected deposit region. Chute 60 is preferably fabricated from suitable steel support plates to form a shell in which refractory materials, such as refractory bricks, are placed to form a lined discharge trough.

The chute 60 may have any suitable configuration appropriate for the particular furnace installation. In the illustrated embodiment, the chute 60 slopes somewhat downwardly from the slag opening 52 and has a cross-sectional configuration generally corresponding to the configuration of the slag opening 52. It will be appreciated, however, that the configuration of the chute 60 need not necessarily match the configuration of the slag opening 52.

Figure 6A:
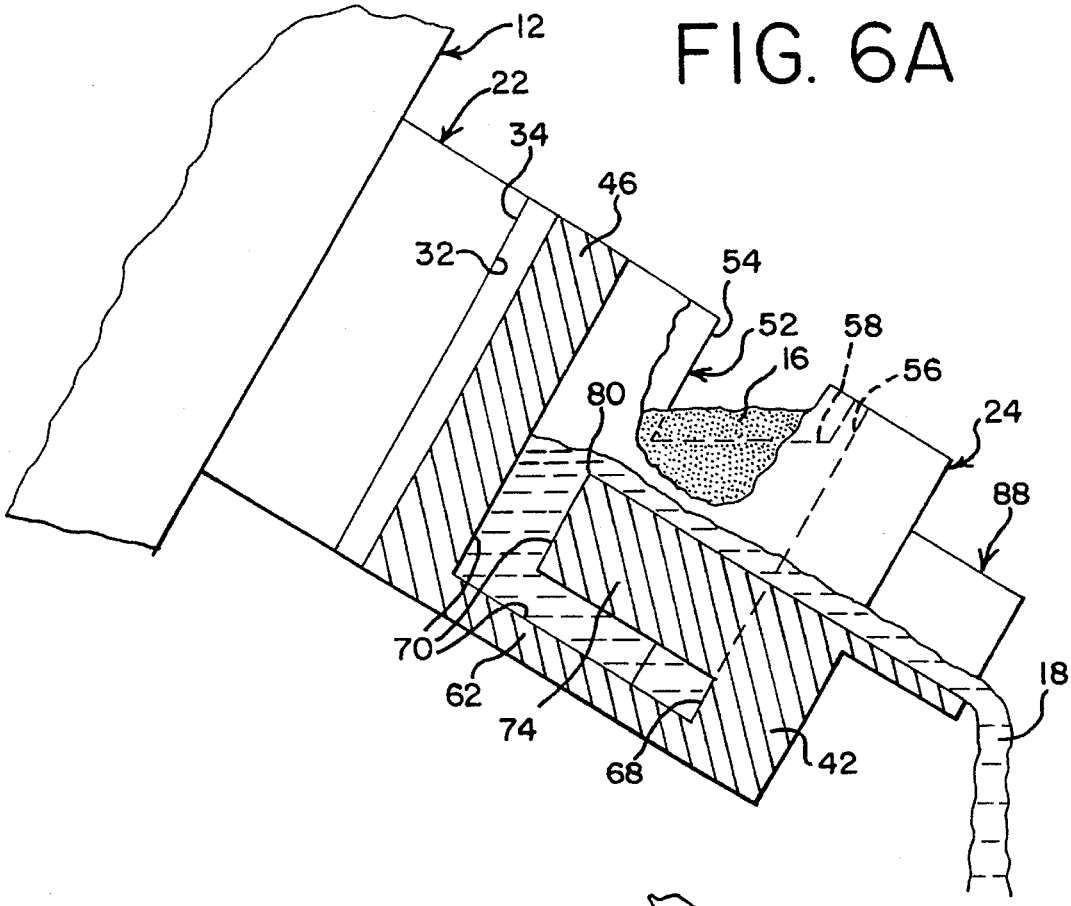
FIG. 6A is a view similar to FIG. 5 with certain portions cut away to illustrate interior detail, but showing the apparatus after the furnace has been tilted to about 30°.
Figure 6B:
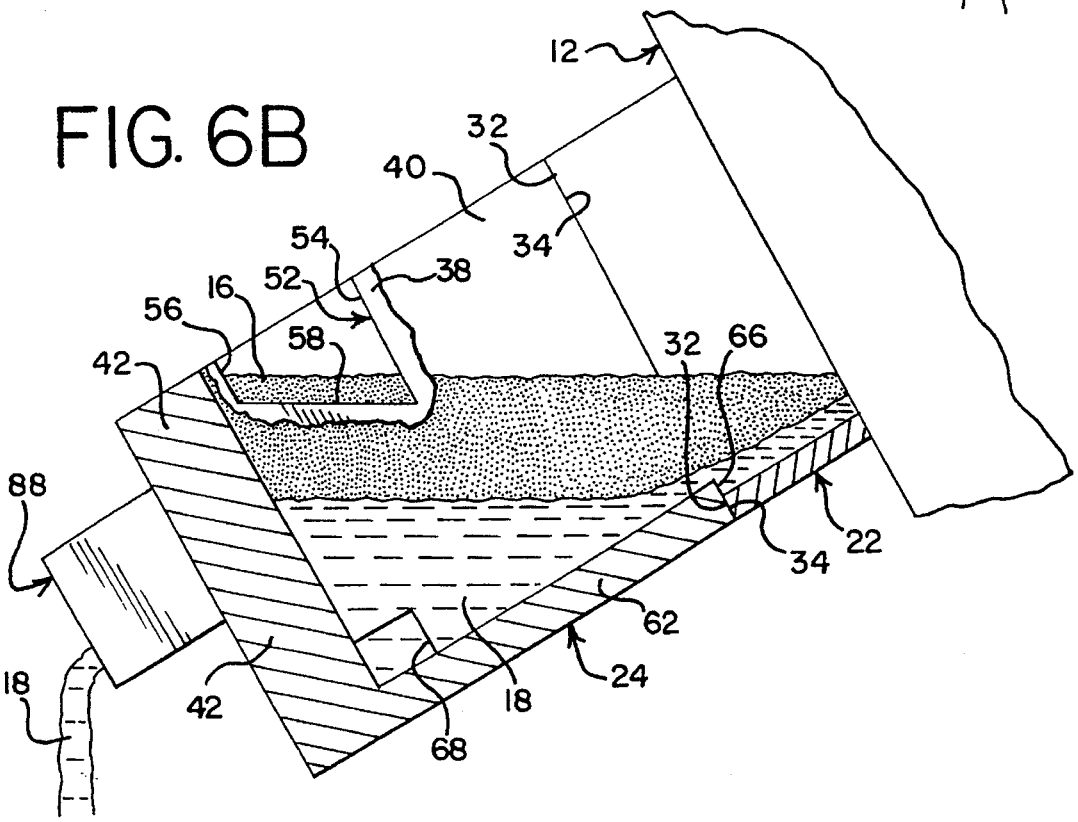
FIG. 6B is a fragmentary, cross-sectional view, taken generally along the plane 6B—6B in FIG. 3, of a portion of the slag control apparatus with the furnace having been tilted about 30° from the normal upright position shown in FIG. 3, and FIG. 6B thus corresponds to FIG. 6A with respect to the tilt angle and flow conditions, it being realized that a portion of the apparatus side wall and a slag opening are shown in FIG. 6B in elevation superimposed upon the cross-section.

The bottom of the device 24 is defined by a bottom wall or floor 62. As best illustrated in FIG. 6B, the surface of the floor 62 is higher than the surface of the bottom of the trough 22 so that a vertical wall 66 is defined by a step at the Junction between the distal end of the trough 22 and the device inlet end 34. In a presently contemplated embodiment, the height of the vertical wall 66 of the step is about 3 inches and results from the use of two layers of a conventional refractory brick in the bottom of the trough 22 and three layers of refractory brick to form the device bottom wall 62. The conventional refractory brick is 3 inches high, and the extra layer of brick in the device bottom wall 62 results in the upper surface of the bottom wall 62 being 3 inches higher than the surface of the bottom of the trough 22.

The vertical wall 66 formed by the device bottom wall 62 defines a barrier or dam. When the furnace 12 is in the normal upright position, the wall 66 is vertical. The wall 66 will function as a dam if the furnace tap hole 14 (FIG. 2) is inadvertently opened when the furnace is in the upright position. To the extent that the floating slag 16 in the furnace may be at, or extend above, the tap hole 14, some slag could flow out of the inadvertently opened tap hole into the horizontal trough 22. The vertical wall 66 would serve to prevent all or most of the inadvertently discharged slag 16 from entering the device 25 until the furnace is ready to be tapped and the furnace is tilted to discharge the slag and molten metal.

The intermediate wall 40 defines a bottom opening 68 (FIGS. 3 AND 4) which is in communication with the reservoir 36. The bottom opening 68 is preferably located at the bottom of the intermediate wall 40 at the forward end of the floor 62 so that the top surface of the floor 62 defines the bottom of the opening 68. However, the opening 68 could be located somewhat higher up and/or somewhat rearwardly in the wall 40. The opening 68 could also be provided as a tunnel or passage in or through the floor 62 or front wall 42 so as to extend from the reservoir 36 under or around the intermediate wall 40 to the other side of the intermediate wall 40.

As best illustrated in FIG. 4, the device 24 defines a passage 70 on the side of the intermediate wall 40 facing away from the reservoir 36. This passage 70 may thus be characterized as being laterally adjacent, or offset from, the reservoir 36.

The passage 70 communicates at one end with the opening 68 and has a horizontal, first portion that preferably extends along the top of the floor 62 rearwardly toward the device back wall 46. The top of the horizontal portion of the passage 70 is defined by an intermediate shelf portion 74 which extends rearwardly from the device front wall 42. The passage 70 includes an upwardly extending portion between the rear end of the shelf portion 74 and the back wall 46. The rear, distal end of the shelf portion 74 functions as a weir and serves to define a part of the vertical portion of the passage 70. In this preferred configuration, the bottom opening 68 is located further outwardly from the furnace than the weir.

As best illustrated in FIG. 4, the intermediate shelf portion 74 defines a rear, top edge 80 which functions as the top of the weir and may be characterized as a flow point or flow line over which the molten metal 18 can flow when the furnace 12 is tilted during the tap discharge.

The top of the intermediate shelf portion 74, in conjunction with the side wall 50 and intermediate wall 40, define a flow channel which extends to an outlet or discharge opening 84 (FIG. 3) in the device front wall. Preferably, a small trough 88 is mounted to the device front wall 42 at the discharge opening 84 to assist in directing the molten metal into a ladle (not illustrated).

It will be appreciated that the passage 70 is laterally offset relative to the reservoir 36. This novel arrangement permits, among other things, the slag opening 52 to be located relatively close to the device front wall 42. Indeed, with reference to FIG. 4, the slag opening 52 is preferably located further outwardly than is the weir top flow edge 80.

Figure 7:
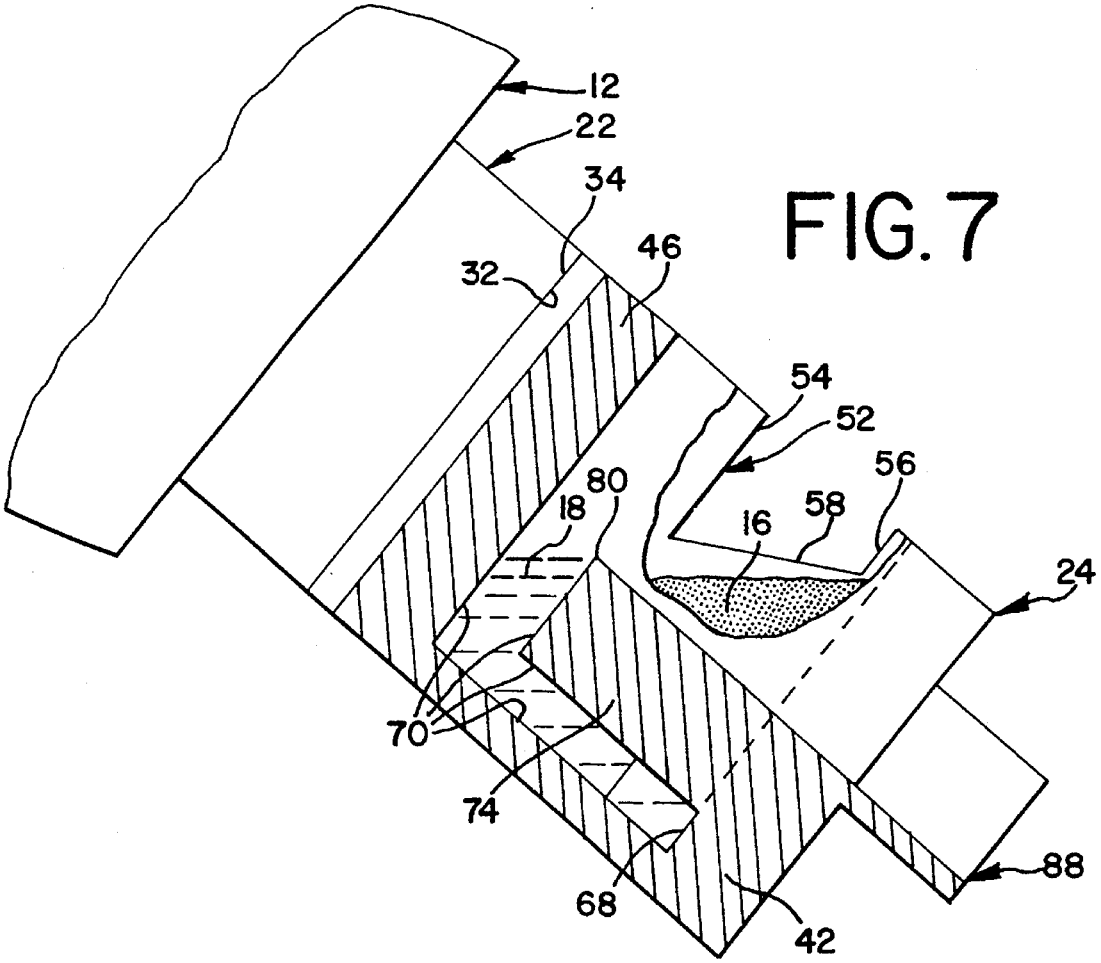
FIG. 7 is a view similar to FIG. 6A with certain portions cut away to illustrate interior detail, but showing the apparatus after the furnace has been tilted to about 40° from the upright orientation and held in that position until the end of the tap.

Preferably, the slag opening has a configuration such that the lowest part of the opening 52 is located at a level which is a predetermined distance above the level of the weir top edge 80. Further, in the presently contemplated preferred embodiment, the slag opening bottom wall 58 is oriented at an angle having the following relationships with respect to the other parts of the system:

1. When the furnace 12 is in the vertical, upright position (FIG. 2) or tilted only a small amount (FIG. 4), the slag opening bottom wall 58 slopes upwardly toward the device front wall 42 so that the low point of the slag opening is defined at the intersection of the bottom wall 58 and the rear vertical wall 54; and 2. When the furnace is fully tilted (at the end of the tap discharge), then the slag opening bottom wall 58 slopes downwardly in the direction away from the furnace 12 so that the low point of the slag opening 52 is then defined at the intersection of the slag opening bottom wall 58 and slag opening vertical front wall 56 (FIG. 7).

In a preferred embodiment, the device floor 62 is about 9 inches thick, the side wall 38 is about 13½ inches thick, the intermediate wall 40 is about 18 inches thick, the side wall 50 is about 13½ inches thick, the front wall 42 is about 13½ inches thick, and the rear wall 46 is about 13½ inches thick. The reservoir 36 is about 22½ inches wide between the walls 38 and 40, about 60 inches deep, and about 72 inches long between the trough end 32 and front wall 42.

The bottom opening 68 is rectangular in cross-section, having about a 15 inch height and about a 9 inch width.

The horizontal portion of the passage 70 is 9 inches high and 18 inches wide, and extends about 57½ inches from the rear edge of the bottom opening 68 to the inside surface of the back wall 46. The vertical, upwardly extending portion of the passage 70, between the distal end of the intermediate shelf portion 74 and the rear wall 46, has a depth of about 27 inches as measured from the floor 62 to the intermediate shelf weir top edge 80. The width of the passage 70, between the intermediate wall 42 and the side wall 50, is about 8 inches, and the length of the passage 70 between the back wall 46 and the intermediate shelf portion 74 is about 12 inches.

The depth or thickness of the intermediate shelf portion 74, from the top horizontal surface of the shelf to the lower horizontal surface of the shelf, is about 18 inches at the rear distal end (adjacent the vertical portion of the passage 70). In a contemplated embodiment, the upper surface of the intermediate shelf 70 may have a small slope (e.g., 4°) from a high point at the weir upper edge 80 to a low point at the device front wall discharge opening 84.

The vertical rear wall 54 of the slag opening 52 is about 23 inches deep, the vertical front wall 56 is about 4 inches deep, and the bottom wall 58 extends between the two walls at an angle of about 30° relative to the normal, horizontal orientation of the device 24.

When the device 24 is in the horizontal orientation (FIG. 3) wherein the furnace 12 is in the vertical, upright position, the low point of the slag opening 52 (at the intersection of the slag opening vertical, rear wall 54 and the slag opening bottom wall 58) is at an elevation of about 12 inches above the intermediate shelf weir top edge 80. Thus, when the furnace is tilted to a conventional full tilt position (e.g., about 40°), the front corner of the slag opening 52 (defined by the intersection of the slag opening vertical, front wall 56 and the slag opening bottom wall 58) would be at an elevation about 9 inches higher than the level of the intermediate shelf weir top edge 80.

Although the device 24 is illustrated as being substantially open, a cover (not illustrated) could be placed over portions of the device 24, and a housing (not illustrated) could be placed around peripheral and bottom portions of the device 24. Such covers and housings, or portions thereof, should, of course, be removable to afford access to the device 24. Such access, at least for viewing purposes, may be desirable with respect to portions of the device 24 during operation. Further, access to the interior of the device 24 may be necessary for maintenance, as well as for repair and/or replacement of the refractory material from time to time.

In operation, the furnace 12 is ready to be tilted after the metal has been melted and heated to the desired temperature. The furnace 12 is then tilted, and the tap hole 14 is necessarily carried downwardly by the furnace wall until the tap hole 14 is well below the level of the floating slag 16.

The molten metal 18 flows through the tap hole 14 while the floating slag 16 remains inside the furnace 12. As the molten metal 18 drains from the furnace 12, the operator increases the tilt of the furnace 12 in order to keep the floating slag 16 above the level of the tap hole 14.

When the molten metal 18 initially flows into the trough 22, it will begin to fill and flow through the device 24. The molten metal 18 flows from the reservoir 36 through the bottom opening 68 into the passage 70. Thus, the intermediate wall 40 functions as a dam that retains molten metal 18 and slag 16 in the reservoir 36 while permitting molten metal 18 in the bottom of the reservoir 36 to pass through the bottom or dam opening 68 and into the passage 70. The molten metal 18 then flows rearwardly through the horizontal portion of the passage 70 and upwardly through the vertical portion of the passage 70.

As the furnace is being increasingly tilted, the molten metal 18 spills over the weir top edge 80 on the intermediate shelf 74, flows along the top of the shelf 74 to the discharge opening 84, and discharges through a small trough 88.

As discussed above, the molten metal 18 flowing through the tap hole 14 may tend to vortex. The vortexing of the molten metal 18 will draw interface slag from the floating furnace slag 16 down into the tap hole 14 where the interface slag will flow with the molten metal 18 through the tap hole 14 and trough 22 to the reservoir 36.

Although vortexing occurs as the molten metal 18 flows through the tap hole 14, little or no vortexing occurs as molten metal 18 flows through the dam opening 68.

The interface slag that is drawn into the trough 22 separates from the molten metal 18 and rises to the surface to form the layer of floating slag 16 in the trough 22 along with any other surface slag that may have been inadvertently discharged from the furnace 12.

During the tap, when the molten metal 18 is flowing in the trough 22, the operator may view the trough 22 from an elevated vantage point which allows him to see into the slag chute 60 and trough 22. He can adjust the tilt of the furnace 12 to control the rate at which the molten metal 18 and slag 16 are flowing through the tap hole 14 and into the trough 22 and thereby control the level of molten metal 18 and slag 16 in the reservoir 36 during the tap. If the depth of molten metal 18 and slag 16 in the reservoir 36 becomes too great, then the operator can slow down, or temporarily stop or reverse, the tilting of the furnace 12.

As the molten metal 18 is drained from furnace 12, the operator gradually increases the tilt of the furnace 12 to maintain the depth of molten metal 18 and slag 16 in the reservoir 36. As can be seen in FIGS. 4–7, when the molten metal is being discharged from the trough 22, the level of molten metal 18 in the reservoir 36 is always kept below the bottom wall 58 of the slag opening 52, while some thickness of the layer of floating slag 16. is kept above the bottom wall 58 of the slag opening 52. Thus, the molten metal 18 does not flow through the slag opening 52, but floating slag 16 does flow through the slag opening 52 into the slag chute 60 as shown in FIGS. 1, 4, 5, 6A and 6B.

As the amount of floating slag 16 in the device 24 increases, the thickness of the layer of floating slag 16 will increase. FIGS. 4–7 show this increase in the depth of floating slag 16. The thick layer of floating slag 16 in the reservoir 36 can somewhat depress the level of the molten metal 18 in the reservoir 36 compared to the level of the molten metal 18 flowing over the weir edge 80.

After the molten metal 18 has substantially drained from the furnace 12, most of the remaining floating slag 16 in the furnace 12 will continue to flow through the tap hole 14 and into the trough 22 and device 24. This will usually begin to occur when the furnace 12 is tilted to between about 35° and about 38° from vertical—in a conventional electric arc furnace which tilts from 0° to approximately 45° from vertical. As the furnace 12 continues to tilt to its fully-tilted position, this flow of slag 16 through the tap hole 14 will cause the amount of slag 16 in the device 24 to greatly increase. This flow of slag 16 through the furnace tap hole 14 will be evident to the operator, who will see an increase in the amount of floating slag 16 in the trough 22 and in the reservoir 36 of the device 24.

After substantially all of the molten metal 18 has been drained from the furnace 12 into the trough 22 and device 24, the molten metal 18 in the device 24 will stop flowing over the weir edge 80 at the top of the passage 70 and will remain at the level of the top edge 80 as shown in FIG. 7. After this occurs, and after the slag 16 has been discharged from the reservoir 36 through the slag opening 52 down to the level of the opening bottom wall 58, the operator stops any further tilting of the furnace 12 and returns the furnace 12 to the upright position.

The density of the slag 16 is much less than that of the molten metal 18, and the level of slag in the reservoir 36 is not sufficient to overcome the static head of the molten metal 18 in the horizontal and vertical portions of the passage 70. The slag 16 in the reservoir 36 does not lower the level of the molten steel 18 in the reservoir 36 so far as to allow the slag 16 to flow through the dam opening 68 and into the passage 70. Thus, the slag 16 does not flow through the device 24 and out of the discharge opening trough 88.

As the operator returns the furnace 12 to the upright position, most of the remaining molten metal 18 and slag 16 in the device 24 will flow back along the trough 22 to the furnace 12. If desired, a drain system (not illustrated) may be provided in the bottom of the device 24 to assist in emptying the device. This could include a normally plugged drain hole, or slight slopes in the floor portions of the passage 70 and/or reservoir 38 for facilitating a flow out of the device 24 and into the trough 22 when the furnace is upright.

It has been found that the novel design of the reservoir 36, in conjunction with the laterally offset passage 70, can be operated in a manner that substantially eliminates, or at least greatly minimizes, flow irregularities that might otherwise exist. The reservoir 36 provides a sufficient static head to effect a flow of the molten metal 18 out of the device 24 while accommodating an increasingly thick layer of floating slag 16 in the reservoir 36. This novel arrangement reduces the probability that slag 16 will be entrained or drawn into the molten metal flow through the dam opening 68 to the passage 70. This is especially important near the end of the tap discharge process when the ratio of molten metal 18 to the slag 16 in the flow from the tap hole has significantly decreased.

With reference to FIG. 4, it will be appreciated that when the furnace 12 is partially tilted (e.g., about 15°), the slag 16 initially flows through the slag opening 52 at the low point of the opening 52 which is then defined at the intersection of the slag opening vertical, rear wall 54 and the slag opening bottom wall 58. However, as the furnace tilt angle increases, the forward end of the slag opening bottom wall 58 drops to an elevation which is at the same elevation as the rear end of the slag opening bottom wall. For the illustrated design, this occurs when the furnace has been tilted about 30° from vertical as illustrated in FIGS. 6A and 6B. Finally, as the furnace is tilted further, the forward end of the slag opening bottom wall 58 drops to a level below that of the bottom wall rear end (e.g., FIG. 7).

In this way, the shape of the slag opening 52 can accommodate the discharge of the slag layer 16 through increasing angles of tilt. The normally, upwardly angled bottom wall 58 of the slag opening prevents the low point of the slag opening from dropping too far with an increasing tilt angle near the end of the tap discharge process.

It will also be appreciated that the slag opening 52, in the preferred embodiment illustrated, is located outwardly beyond the intermediate shelf weir top edge 80 over which the molten metal 18 flows. This novel arrangement results In a decreasing distance between the elevation of the bottom of the slag opening 52 and the weir top edge 80 as the furnace tilt angle increases. This configuration operates to reduce the thickness of the layer of floating slag 16 in the reservoir 36 during the tap discharge process.

The novel apparatus of the invention can readily accommodate design features which serve to provide a rugged apparatus that is less susceptible to wear and degradation from flowing metal and high temperatures. For example, the intermediate shelf portion 74 can have a relatively great thickness, such as 18 inches in the contemplated preferred embodiment described herein. This invention thus does not require the use of relatively thin structures adjacent, or defining, flow passages. The absence of thin structures from embodiments of the apparatus of the present invention can result in a longer operating life for the apparatus and/or portions thereof.

The apparatus of the present invention can be embodied in designs that will accommodate relatively high flow rates which may equal, or significantly approach, the flow rates exhibited by a conventional open-ended discharge trough. Thus, the additional time required for a tap discharge with the present invention can be kept to a minimum so as to avoid excessive temperature drops in the molten metal and so as to avoid excessive heat build up in the apparatus.

Although not illustrated, the device 24 could be mounted as illustrated to the end of a trough on a conventional furnace. However, in the preferred embodiment of the present invention, the device 24 is mounted as illustrated to the end of a trough 22 which is oriented substantially horizontally with respect to the normal, vertical, upright position of the furnace 12.

With this arrangement, the furnace 12 does not have to be tilted at the beginning of the pour compared to furnaces which incorporate a trough that is angled slightly upwardly. That is, the invention device 24, when mounted on the end of the horizontal trough 22, swings downwardly with the tilting of the furnace 12 so that the weir top edge 80 is initially at a relatively low elevation to accommodate the flow of molten metal and slag at the beginning of the pour.

This can be important in conventional, water-cooled furnaces wherein water cooling jackets are provided in the upper portions of the furnace above the tap hole. When discharging from such a furnace, care must be taken not to tilt the furnace too much during the initial part of the pour. If the furnace is tilted excessively during the initial part of the pour, then the great quantity of molten steel that is initially in the furnace could accidentally contact the upper, cooling jacket portions of the furnace. This can result in an explosion.

The present invention aids the operator of the furnace in avoiding excessive tilting of the furnace that could cause an explosion. In a preferred construction, the slag separating device is configured such that when the furnace is tilted too quickly, then the molten steel in the reservoir will flow out of the slag opening before the molten steel in the furnace makes contact with the cooling jackets inside the furnace. The flow of molten steel out of the slag opening may be observed by the operator, who can then reduce the angle of tile until steel stops flowing out of the slag opening. Thus, the undesirable contact between molten metal and the cooling jackets in the furnace is avoided.

This invention controls slag in a tap discharge of molten metal and floating slag by employing a novel apparatus and method for directing the flow of the slag and molten metal through a flow path in a trough and attached device in which the slag and molten metal are separately discharged in an efficient and effective manner.

Figure 8:
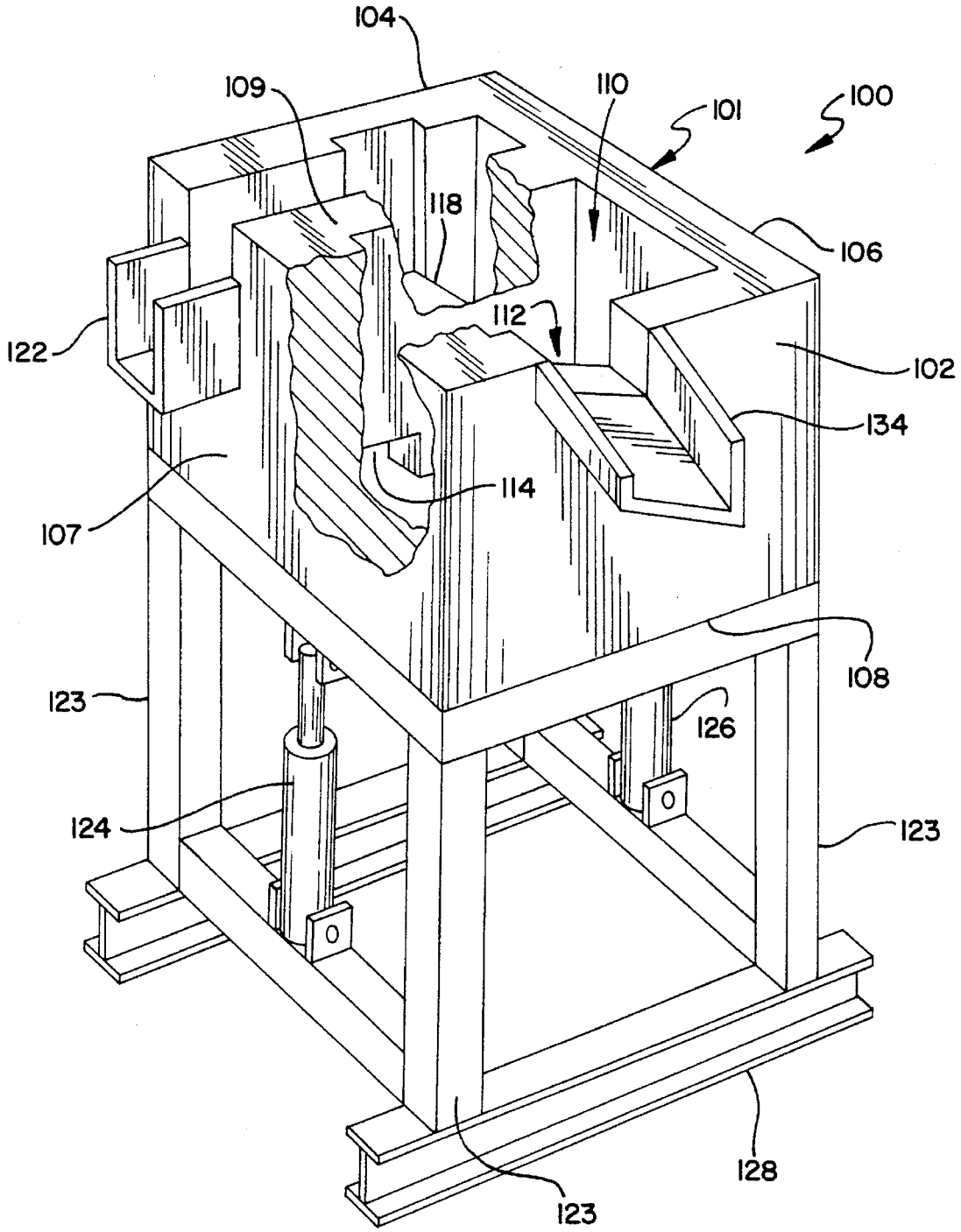
FIG. 8 is a simplified perspective view of a free standing slag separating unit in accordance with the invention with portions cut away to illustrate interior detail.

Referring to FIG. 8, an alternative embodiment of the invention is a tilting free-standing unit 100 having a vessel 101 with a design that is nearly identical to the slag separating device 24 attached to the tilting furnace 12 as described above. The vessel 101 has two side walls 102 and 104, a rear wall 106, a front wall 107, a bottom wall or floor 108 and an intermediate wall 109. A reservoir 110 is defined by the side wall 102, rear wall 106, intermediate wall 109 and front wall 107. The side wall 102 has a lateral opening 112. The intermediate wall 109 functions as a dam with a bottom opening 114 (hereinafter referred to as the dam opening 114) as its lower front end.

Figure 10:
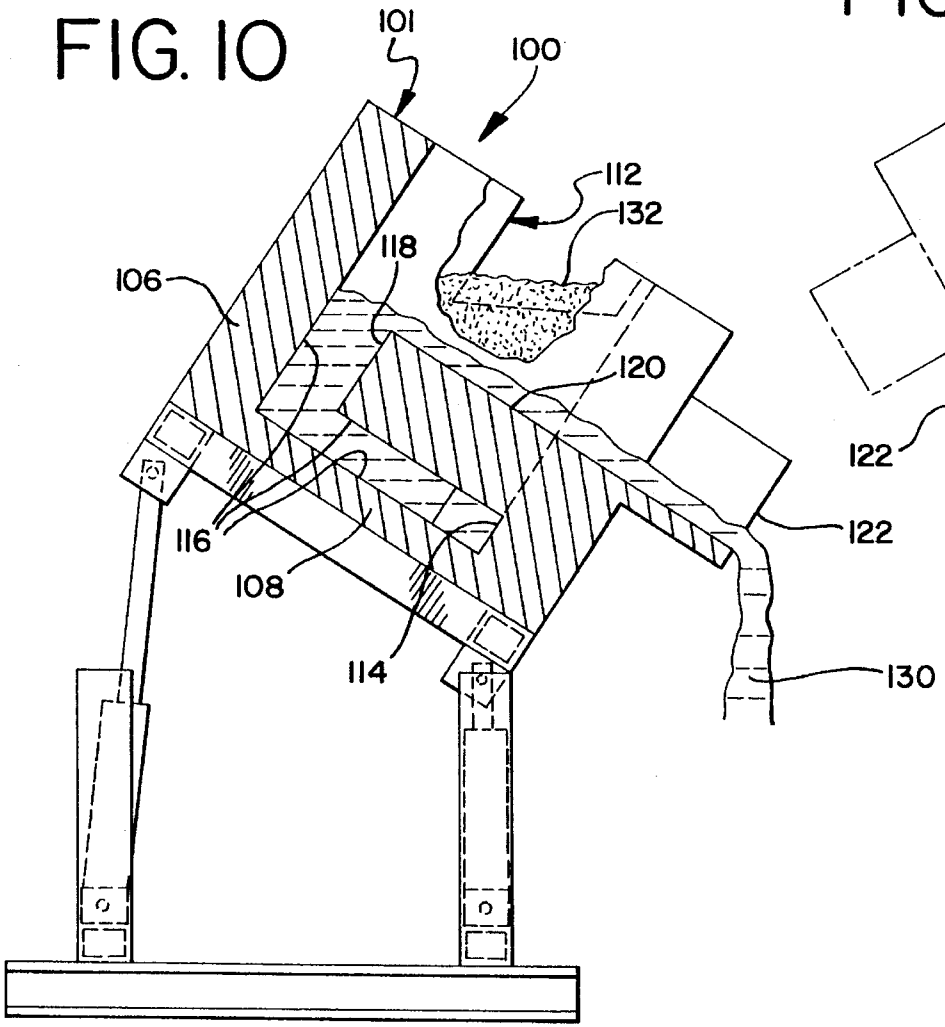
FIG. 10 is a cross-sectional view of the unit as shown in FIG. 9 with certain portions cut away to illustrate interior detail.

A passage 116 is defined in part by the intermediate wall 109 and side wall 104. Thus, the passage 116 is laterally offset from the reservoir 110. Referring to FIG. 10, the passage 116 extends rearwardly from the dam opening 114 and then upwardly between the rear wall 106 and a weir portion 118. A shelf portion 120 extends forwardly from the weir 118 to a discharge opening 122.

In a preferred embodiment, the dimensions, proportions and materials of the vessel 101, including the side walls 102 and 104, front wall 107, floor 108, intermediate wall 109, lateral opening 112, dam opening 114, passage 116, weir 118, shelf portion 120 and discharge opening 122 are the same as the materials, dimensions and proportions of the slag separating device 24, including its corresponding elements, as described above. The rear wall 106 is constructed from the same materials, and in the same dimensions and proportions as the other walls 102, 104, 107, 108 and 109. The locations of the lateral opening 112, the dam opening 114, passage 116, weir 118, shelf portion 120 and discharge opening 122 relative to each other, are identical to the locations of the corresponding elements in the slag separating device 24 described above. Therefore, except for the extension of the rear wall 106 across the entire rear end of vessel 101, vessel 101 is virtually identical to the slag separating device 24 described above.

Referring to FIG. 8, the vessel 101 rests on top of four support legs 123 (one leg not shown). the vessel 101 is not attached to the legs 123. A pair of hydraulic cylinders 124 and 126 are hingeably attached to the bottom of the unit 100. The hydraulic cylinders 124 and 126 extend downwardly from the vessel 101 and are hingeably attached to a base portion 128. The hydraulic cylinders 124 and 126 are actuated by conventional means for extending and retracting independently in a controlled manner. The hydraulic cylinders 124 and 126 function as additional legs that extend and retract in order to raise, lower or tilt the vessel 101.

Figure 9:
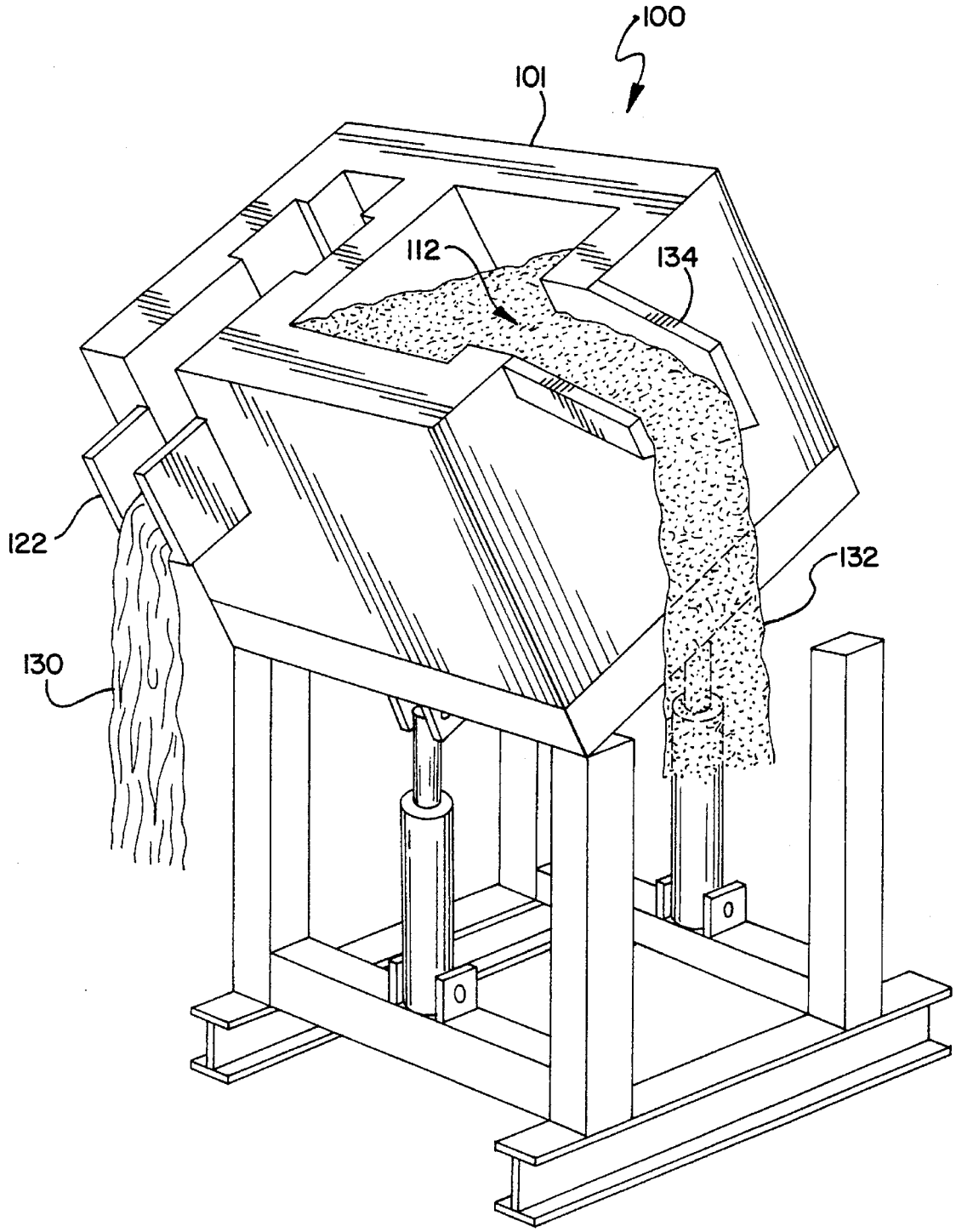
FIG. 9 is a perspective view of the free standing unit shown in FIG. 8 wherein the unit is tilted and molten metal and slag are being discharged.

In operation, molten metal and slag are poured into the reservoir 110 while the vessel 101 is level. The vessel 101 is then tilted by actuating one or both cylinders 124 and 126 in order to raise the rear end and/or lower the front end and tilt the vessel 101 forward. Referring to FIG. 9, slag 112 floats on top of molten metal (not illustrated).

Referring to FIGS. 9 and 10, when the vessel is tilted, molten metal 130 is discharged from the discharge opening 122 and slag 132 is discharged from the lateral opening 112. Within the vessel 101, molten metal 130 flows through the dam opening 114 and passage 116, over the weir 118 and shelf portion 120, and out of the vessel 101 through the discharge opening 122. Thus, the molten metal 130 flows rearwardly and then upwardly in the passage 116. As the molten metal 130 rises in the vertical portion of the passage 116, a pressure head is created which maintains a minimum depth of molten metal 130 in the reservoir 110 and prevents floating slag 132 from flowing through the dam opening 114 and out of the discharge opening 122. Floating slag 132 in the reservoir 110 flows out of the lateral opening 112 to a discharge chute 134.

The relative orientation, heights and distances of the lateral opening 112, dam opening 114 and weir 118, are identical to the relative orientation, heights and distances of the corresponding elements in the slag separating device 24 described above and function to maintain a minimum depth of molten metal 130 in the reservoir that prevents floating slag 132 from passing through the dam opening 114 as the vessel 101 is tilted. Further, these elements cooperate as the vessel 101 is tilted wherein the lateral opening 112 is lowered relative to the weir 118 as the vessel 101 is tilted in a manner identical to that described above regarding the slag separating device 24.

Figure 11:
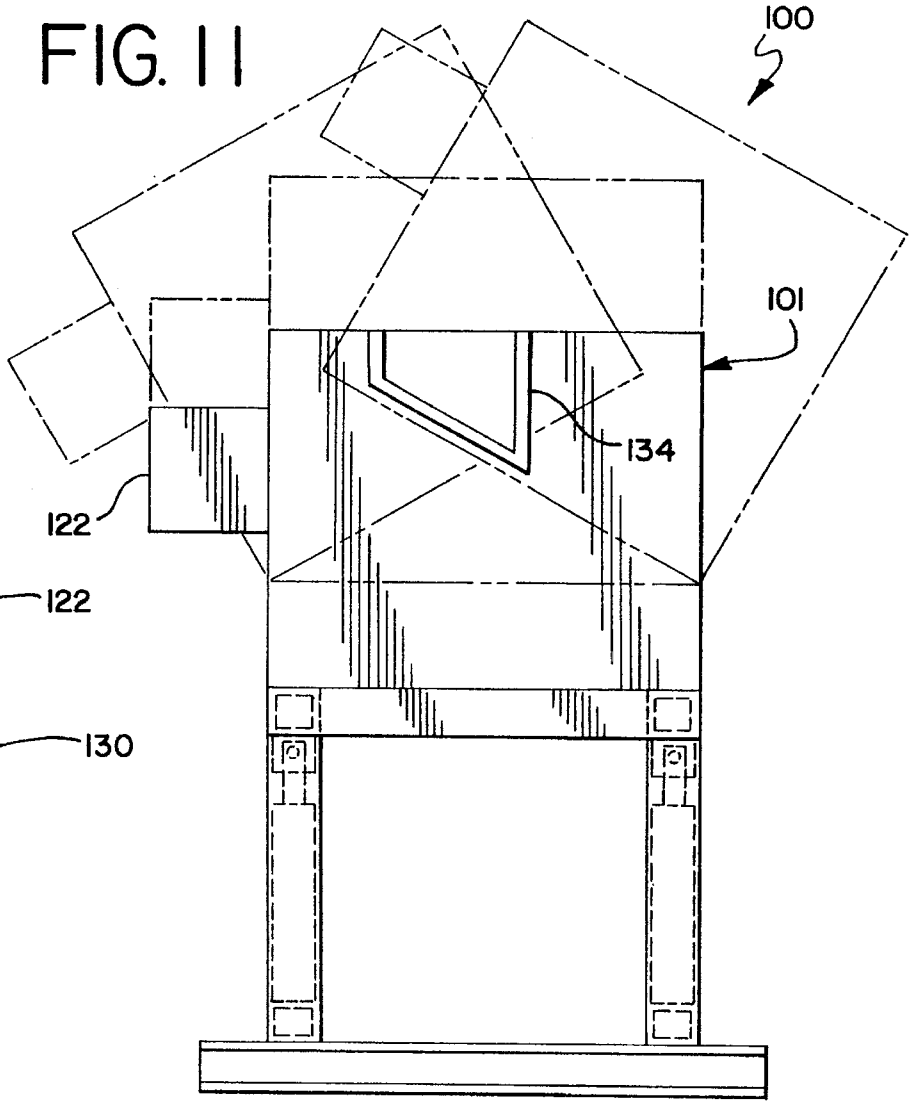
FIG. 11 is an elevational view of the slag separating unit shown in FIG. 8.

Referring to FIG. 11, the vessel 101 can be raised, tilted forwardly, or tilted rearwardly by the hydraulic cylinders 124 and 126 as shown by the phantom lines. Therefore, the vessel 101 may be moved to any height to receive and/or discharge molten metal and slag.

Further, although the invention has been described and depicted as in a preferred embodiment, it will be apparent that other variations and modifications as come within the scope of the appended claims can be considered part of the present invention without departing from the true spirit and scope of the novel concepts or principles of the invention.

What is claimed is:

1. A method for controlling slag in a tap discharge of molten metal and floating slag from a tap hole of a tilting furnace which is variably tiltable between an upright, non-tilted position and a fully tilted position, said furnace having a trough extending outwardly from said tap hole for directing the flow of said molten metal and slag from said furnace to a discharge outlet, said method comprising the steps of:

(a) sufficiently tilting said furnace and trough to discharge said molten metal and slag from said tap hole into said trough whereby said molten metal can flow under the influence of gravity out of said discharge outlet during the following steps (b) through (c);

(b) directing said flow of molten metal sequentially into a reservoir from which said slag can be discharged, into a passage from a bottom opening in said reservoir, generally upwardly along a weir that is partly defined by said passage, and over the top of said weir to said outlet;

(c) retaining said slag in said reservoir while permitting said molten metal to flow out of said outlet; and (d) discharging said retained slag through a slag opening defined by said reservoir while maintaining said slag opening at least as far outwardly as is said weir and at a level above the level of said bottom opening.

2. The method in accordance with claim 1 wherein said step (c) includes:

maintaining the level of said molten metal below the bottom of said slag opening; and said step (d) includes:

maintaining the level of the top of said floating slag in said reservoir above at least a portion of the bottom of said slag opening.

3. A method for controlling slag in a tap discharge of molten metal and floating slag from a tap hole of a tilting furnace which is variably tiltable between an upright, non-tilted position and a fully tilted position, said furnace having a trough extending outwardly from said tap hole for directing the flow of said molten metal and slag from said furnace to a discharge outlet, said method comprising the steps of:

(a) sufficiently tilting said furnace and trough to discharge said molten metal and slag from said tap hole into said trough whereby said molten metal can flow under the influence of gravity out of said discharge outlet during the following steps (b) through (c);

(b) directing said flow of molten metal sequentially into a reservoir from which said slag can be discharged, into a laterally offset passage from a bottom opening in said reservoir, generally upwardly along a weir that is partly defined by said passage, and over the top of said weir to said outlet;

(c) retaining said slag in said reservoir while permitting said molten metal to flow out of said outlet; and (d) discharging said retained slag through a slag opening defined by said reservoir.

4. The method in accordance with claim 3 wherein step (b) includes directing said flow of molten metal generally rearwardly from said bottom opening in said passage and step (d) includes discharging said slag through said slag opening located at a level above the level of said bottom opening.

5. A method for separating molten metal from slag in a tilting vessel, said vessel having a discharge outlet, said method comprising the steps of:

(a) sufficiently tilting said vessel whereby said molten metal can flow under the influence of gravity out of said discharge outlet during the following steps (b) through (c);

(b) directing said flow of molten metal sequentially into a reservoir from which said slag can be discharged, laterally into a passage from a bottom opening in said reservoir, generally upwardly along a weir that is partly defined by said passage, and over the top of said weir to said outlet;

(c) retaining said slag in said reservoir while permitting said molten metal to flow out of said outlet; and (d) discharging said retained slag through a slag opening defined by said reservoir while maintaining said slag opening at least as far outwardly as is said weir and at a level above the level of said bottom opening.

6. The method in accordance with claim 5 wherein said step (c) includes:

maintaining the level of said molten metal below the bottom of said slag opening; and said step (d) includes:

maintaining the level of the top of said floating slag in said reservoir above at least a portion of the bottom of said slag opening.

7. A method for separating molten metal from slag in a tilting vessel, said vessel having a discharge outlet, said method comprising the steps of:

(a) sufficiently tilting said vessel whereby said molten metal can flow under the influence of gravity out of said discharge outlet during the following steps (b) through (c);

(b) directing said flow of molten metal sequentially into a reservoir from which said slag can be discharged, into a laterally offset passage from a bottom opening in said reservoir, generally upwardly along a weir that is partly defined by said passage, and over the top of said weir to said outlet;

(c) retaining said slag in said reservoir while permitting said molten metal to flow out of said outlet; and (d) discharging said retained slag through a slag opening defined by said reservoir.

8. The method in accordance with claim 7 wherein step (b) includes directing said flow of molten metal generally rearwardly from said bottom opening in said passage and step (d) includes discharging said slag through said slag opening located at a level above the level of said bottom opening.

9. A method for separating molten metal from slag in a tilting vessel, said vessel having a discharge outlet, said method comprising the steps of:

(a) sufficiently tilting said vessel whereby said molten metal can flow under the influence of gravity out of said discharge outlet during the following steps (b) through (c);

(b) directing said flow of molten metal sequentially into a reservoir from which said slag can be discharged, into a passage from a bottom opening in said reservoir, generally rearwardly within said passage and then upwardly along a weir that is partly defined by said passage, and over the top of said weir to said outlet;

(c) retaining said slag in said reservoir while permitting said molten metal to flow out of said outlet; and (d) discharging said retained slag through a slag opening defined by said reservoir.

10. A method for separating molten metal and slag in a tiltable vessel, said vessel defining an open discharge end and a lateral opening inwardly of said open discharge end, said method comprising the steps of:

(a) sufficiently tilting said vessel whereby said molten metal can flow under the influence of gravity out of said vessel at said discharge end;

(b) damming said molten metal and slag and retaining said slag in said tiltable vessel while permitting said molten metal to flow out of said vessel in said tilted condition; and (c) discharging said retained slag through said lateral opening in said tiltable vessel to a location remote from said discharge end.

11. The method in accordance with claim 10 wherein step (b) includes employing a weir across said vessel inwardly of said lateral opening to establish, for a selected angle of tilt of said vessel, a minimum depth of molten metal flow in a portion of said vessel.

12. The method in accordance with claim 10 in which:

step (b) includes providing a dam across said vessel between said lateral opening and said discharge end with at least one of said dam and said vessel defining a discharge passage for permitting the flow of said molten metal past said dam below the top of said dam; and step (a) includes tilting said vessel to maintain the level of said slag above the level of said discharge passage as said slag floats on said molten metal while said molten metal flows through said discharge passage and out of said vessel.

13. The method in accordance with claim 10 wherein step (a) includes increasing the angle of tilt of said vessel while molten metal flows out of said vessel at said discharge end.

14. The method in accordance with claim 10 wherein step (b) includes controlling the rate of flow of said molten metal out of said holding means so as to control said damming.

15. A method for separating molten metal and slag in a tiltable vessel, said vessel defining an open discharge end and a lateral opening inwardly of said open discharge end, said method comprising the steps of:

(a) sufficiently tilting the vessel to discharge said molten metal and slag whereby said molten metal can flow under the influence of gravity out of said vessel at said discharge end;

(b) establishing, for a selected angle of tilt of said vessel, a minimum depth of molten metal flow in a portion of said vessel with a weir across said vessel downstream of said lateral opening, and directing said flow rearwardly in a portion of said vessel;

(c) damming the molten metal and slag flow between said weir and said lateral opening while permitting said molten metal to flow past said dam at a level below the top of said dam to retain said slag floating on top of said molten metal behind said dam; and (d) discharging the retained slag through said lateral opening.

16. A method for separating molten metal and slag in a tiltable vessel, said vessel defining an open discharge end and a lateral opening inwardly of said open discharge end, said method comprising the steps of:

(a) sufficiently tilting said vessel whereby said molten metal can flow under the influence of gravity out of said vessel at said discharge end;

(b) providing a fixed dam extending upwardly in said vessel from an elevation in said molten metal below said slag to an elevation above said slag and then damming and retaining said molten metal and slag in said tilted vessel while permitting said molten metal to flow out of said vessel; and (c) discharging said retained slag through said lateral opening in said tilted vessel to a location remote from said discharge end.

17. A method for separating molten metal and slag in a tiltable vessel, said vessel defining an open discharge end and a lateral opening inwardly of said open discharge end, said method comprising the steps of:

(a) sufficiently tilting said vessel whereby said molten metal can flow under the influence of gravity out of said vessel at said discharge end;

(b) establishing, for a selected angle of tilt of said vessel, a minimum depth of molten metal flow in a portion of said vessel with a weir across at least a part of said vessel downstream of said lateral opening, and directing said flow rearwardly and laterally in a portion of said vessel;

(c) providing a fixed dam extending upwardly in said vessel from an elevation in said molten metal below said slag to an elevation above said slag between said weir and said lateral opening and then damming the molten metal and slag flow while permitting said molten metal to flow past said dam at a level below the top of said dam to retain said slag floating on top of said molten metal behind said dam; and (d) discharging the retained slag through said lateral opening.

* * * * *